United States Patent [19]

Meredith

[11] 4,268,263

[45] May 19, 1981

[54] METHOD AND APPARATUS FOR IMMERSION PRINTING OF PILE FABRICS

[75] Inventor: James E. Meredith, Summerville, Ga.

[73] Assignee: Bigelow-Sanford, Inc., Greenville, S.C.

[21] Appl. No.: 125,150

[22] Filed: Feb. 27, 1980

[51] Int. Cl.[3] ..... D06B 1/10; D06B 11/00

[52] U.S. Cl. ..... 8/149; 8/151; 68/204; 101/152; 118/212; 118/257

[58] Field of Search ..... 8/148, 149, 151; 68/200, 204, 147, 171; 101/151, 152, 158; 118/212, 257

[56] References Cited

U.S. PATENT DOCUMENTS

| | | | |
|---|---|---|---|
| 1,268,891 | 6/1918 | Stommel | 118/257 X |
| 1,668,322 | 5/1928 | Kessler, Jr. | 101/152 |
| 2,000,077 | 5/1935 | Harshberger | 118/212 X |
| 2,954,540 | 5/1961 | Tillett et al. | 8/148 |
| 3,991,708 | 11/1976 | Huebschmann et al. | 118/212 X |
| 4,165,547 | 8/1979 | Parlin et al. | 8/148 |

*Primary Examiner*—Philip R. Coe
*Attorney, Agent, or Firm*—Burgess, Ryan and Wayne

[57] ABSTRACT

A horizontally moving belt has a waffle grid surface into the compartments of which dyes are injected in accordance with a desired color pattern to be printed. Carpeting is moved adjacent the waffle grid surface with the pile facing down toward the grid. A counter roller supports the waffle grid at the printing station, and an oppositely disposed protuberance-bearing pressure roller pushes the backing of the carpet so that the pile enters the compartments of the waffle grid and is immersed in the dye pattern. The protuberances ensure adequate immersion of the pile while permitting escape of air and avoiding squeezing of the dye from the pile, which would otherwise occur by engagement of the pressure roller with the grid walls in the absence of the protuberances. The angle of approach of the carpet to the printing station is slightly inclined from the horizontal to ensure a gradual depression of the pile and to avoid rolling the dye out away from the nip region of the printing station.

15 Claims, 7 Drawing Figures

METHOD AND APPARATUS FOR IMMERSION PRINTING OF PILE FABRICS

This invention relates to a method and apparatus for immersion printing of pile fabrics or knitted yarn sleeves, and more particularly to such a process utilizing continuous movement of the fabric by means of a plurality of rollers.

For printing and dyeing of pile fabrics in general and high pile fabrics such as carpeting in particular, an immersion printing process known as the "Tuft Dye" technique has been in commercial use for many years. This technique, which is described in U.S. Pat. No. 2,984,540 to Tillett, et al (assigned to the Assignee of the present application), involves use of a "waffle grid" or multi-compartmented form into the compartments of which dyes are introduced in accordance with a desired color pattern to be printed. High pile fabric such as carpeting is then disposed upside down, i.e., with the pile down, and moved vertically to immerse the pile in the waffle grid form, thereby ensuring saturation dyeing of the carpet, while the compartment walls prevent diffusion of the dye and thereby maintain clear lines of demarcation throughout the pattern.

However, a disadvantage of the tuft dye process is that as presently practiced it is not amenable to continuous roller-guided movement of the pile material, since a section of carpet or other pile material to be dyed must first be moved adjacent to the waffle grid, then moved vertically into contact with the grid compartments and subsequently moved vertically to its initial position, after which the carpet is moved so that a new section to be dyed is disposed adjacent the waffle grid. Thus, the conventional tuft dye process involves vertical reciprocal movements of the carpet with horizontal movements to bring new sections adjacent the waffle grid. In addition to the undesirable complexity and limited speed of this arrangement, indexing problems occur due to the need to accurately register each section of carpet to be printed with the preceding (already printed) section.

Further, the tuft dye process, for all practical purposes, is limited to a 6 pattern repeat and a 4 layer (color) printing form. The cost of a larger printing form would be prohibitive and its control most difficult. The efficiency of operation and the quality of the product would be unacceptable.

In FIG. 22 of the aforementioned U.S. Pat. No. 2,984,540, a proposed arrangement is described for continuous one color immersion dyeing of pile fabrics, employing a waffle grid belt 146 and oppositely disposed pressure roller and counter roller 153 and 157 to urge the carpet 150 into the compartments of the belt 146. Liquid dye is deposited in the compartments of the waffle grid belt by a feed tube 159, in cooperation with a roller 162 and doctor blade 161. This arrangement is described in the portion of said patent running from column 11, line 46 to column 12, line 45.

However, the aforementioned arrangement has not proven to be commercially practicable, since the action which occurs at the dyeing station comprising the rollers 153 and 157 is such that side-to-side color match is difficult.

Accordingly, an object of the present invention is to provide an improved method and apparatus for immersion printing of pile fabrics, which represents an improvement over the arrangement shown in FIG. 22 of the aforesaid U.S. Pat. No. 2,984,540, the disclosure of which is incorporated herein by reference.

As herein described there is provided a process of applying a coloring agent to a fabric having pile on one face thereof wherein an area of pile on the face of the fabric is introduced into a receptacle comprising a movable belt having a multiplicity of compartments with upstanding side walls therebetween and containing a coloring agent in liquid form and the receptacle and the fabric are brought into mutual engagement by exerting pressure against the back of the fabric, the improvement comprising the steps of: driving said belt in a generally horizontal direction at a predetermined speed; feeding said fabric toward said region of engagement; rotating a pressure roller having a protuberance-bearing surface adjacent said belt, at a peripheral speed equal to said predetermined speed and in synchronism with the movement of said belt, adjacent said region of engagement, so that the protuberances of said pressure roller urge said fabric toward each of said compartments; and supplying said coloring agent to said compartments upstream of said region of engagement in accordance with a desired color pattern to be printed on said fabric.

Also herein described is an apparatus for applying a coloring agent to a fabric having a pile on one face thereof wherein an area of pile on the face of the fabric is introduced into a receptacle comprising a movable belt having a multiplicity of compartments with upstanding side walls therebetween for containing a coloring agent in liquid form, and means for bringing the receptacle and the fabric into mutual engagement by exerting pressure against the back of the fabric, the improvement comprising: means for driving said belt in a generally horizontal direction at a predetermined speed; a plurality of rollers for feeding said fabric toward said region of engagement; a counter roller for supporting said belt at said region of engagement; a pressure roller disposed adjacent said belt opposite said counter roller, said pressure roller having a protuberance bearing surface; means for rotating said pressure roller at a peripheral speed equal to said predetermined speed and in synchronism with the movement of said belt, so that the protuberances of said pressure roller urge said fabric toward each of said compartments; and means for supplying said coloring agent to said compartments upstream of said region of engagement in accordance with a desired color pattern to be printed on said fabric.

IN THE DRAWING

Figure 1:
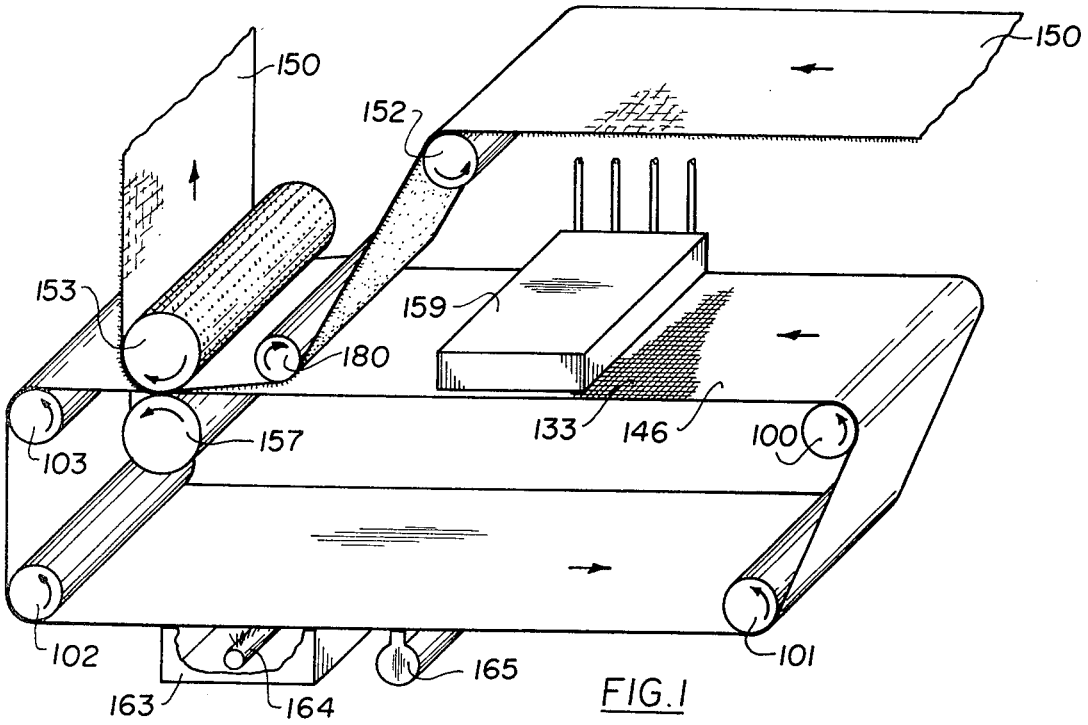
FIG. 1 shows improved apparatus for immersion dyeing of pile fabrics in accordance with a preferred embodiment of the present invention.
Figure 2:
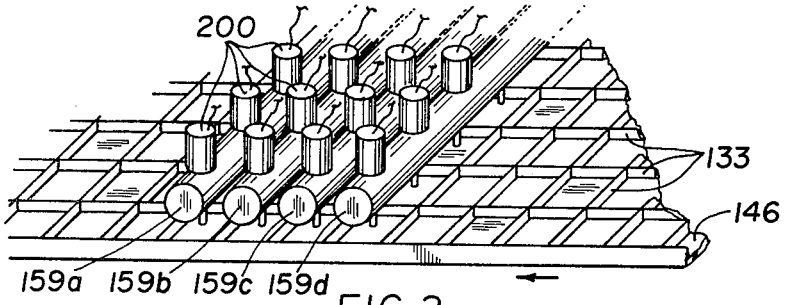
FIG. 2 shows a portion of the waffle grid belt employed in the apparatus of FIG. 1, and the adjacent dye injection arrangement.

As shown in FIG. 1, a flexible "waffle-grid" belt 146 has a multiplicity of compartments formed in the outer surface thereof from rubber or any other suitable material, for receiving liquid coloring agents or dyes, while preventing the dye in each compartment from mixing with dye in adjacent compartments. A portion of this grid is shown in FIG. 2. Each compartment may typically have dimensions on the order of one quarter inch by one quarter inch. The compartment walls 133 may typically have a height on the order of one sixteenth inch.

The endless belt 146 is rotated about rollers 100 to 103. The carpeting 150 is led under roller 180 and over roller 152 and under the pressure roller 153. The idle or counter roller 157 is located beneath the carpet 150 and cooperates with the pressure roller 153 to compress the carpeting against the color compartments in the belt. The liquid coloring material is fed to the color compartments through a color feed assembly 159, which in turn is fed from an outside four color dye source using conventional techniques. The endless belt 146 is led through a washing chamber 163, operating through a water spray 164 and dried by vacuum belt dryer 165. Thus, the endless belt is returned to the color feeding side clean and ready to receive a new charge of a different coloring agent.

As most clearly shown in FIG. 2, the color feed assembly 159 comprises a number of individual color feed transverse arrays **159*a* to 159*d*, each array extending across the width of the waffle grid belt 146 to introduce a desired color into selected compartments of the receptacle comprising the waffle grid belt 146. That is, feed unit 159*a* extends entirely across the belt 146 and is fed with a dye of one desired color, while each of the tubes 159*b*, 159*c* and 159*d* is fed with a dye of another desired color, so that the arrangement shown in FIG. 2** is capable of producing a four color pattern. Of course, additional feed units can be added to provide as many colors as are desired.

Each of the feed units **159*a* to 159*d* has a number of injection valves 200 equal to the number of compartments extending transversely across the belt 146. For a standard three foot belt width and a one-quarter inch compartment size, 144** injection valves per feed unit are required.

A suitable control arrangement, such as a mini-computer, may be employed to actuate the injection valves of the feed units **159*a* to 159*d* to provide an array of dye colors within the compartments of the waffle grid belt 146**, in accordance with a desired pattern to be printed.

As shown in FIG. 1, this dye injection process is carried out just upstream of the printing station defined by the pressure roller 153 and counter roller 157.

The roller 180 is so situated with respect to the pressure roller 153 that the carpeting is fed to the printing station at an angle $\alpha$ (see FIG. 3) with respect to the belt 146 (which is generally horizontal at the printing station), in order to gradually compress the pile of the carpet 150 to gradually depress the carpet pile into the dye within the compartments of the waffle grid to avoid rolling the dye out away from the nip point, i.e., the region of closest engagement of the rollers 153 and 157.

The pressure roller 153 is provided with a multiplicity of protuberances 170 which serve to press against the carpet backing to urge the pile of the carpet 150 into the compartments of the waffle grid belt 146, to provide full immersion printing of the carpet. By ensuring such immersion of the carpet pile, the protuberances 170 permit the use of dyes having greater viscosity than can be employed in existing tuft dye apparatus. Such higher viscosity dyes reduce problems with frostiness and minimize bleeding together of adjacent colors.

Another advantage of the protuberances 170 of the pressure roller 153 is that they allow air to escape from the carpet at the printing station, thus minimizing undesirable suction effects.

A quite different technique for dyeing yarn by using a reciprocating element to immerse the yarn in a series of adjacent compartments containing dyes of different colors, is shown in British Pat. No. 1,475,534. However, such a process is not suitable for the commercial dyeing of pile fabrics.

Figure 3:
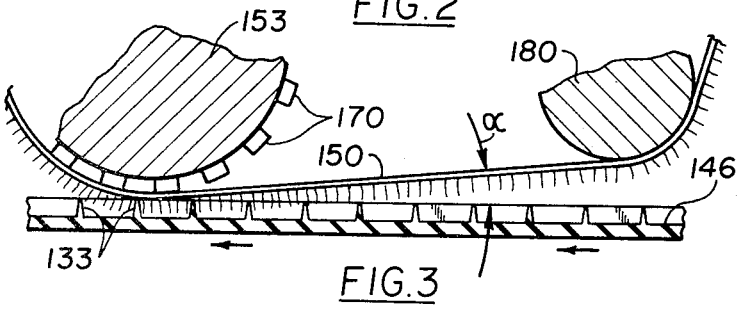
FIG. 3 shows, in schematic form, the manner in which the pile fabric is compressed at the printing zone in the arrangement of FIG. 1.
Figure 4:
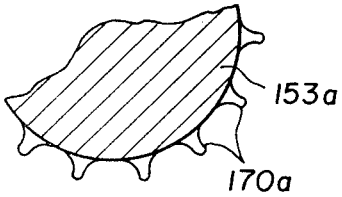
FIG. 4 shows a partial cross-sectional view of a ressure roller in accordance with an alternative embodiment of the invention.
Figure 5:
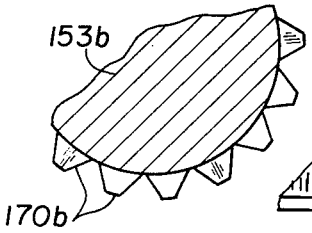
FIG. 5 shows a cross-sectional view of a pressure roller in accordance with a further embodiment of the invention.

The protuberances 170 shown in FIGS. 1 and 3 have a generally cylindrical shape. However, other shapes may be provided for the protuberances 170, as shown in FIGS. 4 and 5. In FIG. 4 a pressure roller **153*a* is provided with protuberances 170*a* which have a generally gear-like shape, having smoothly curved contours tapering to peaks. In FIG. 5, a pressure roller 153*b* is provided with protuberances 170*b*** having shapes generally similar to those of truncated pyramids.

Instead of a system of dye injection nozzles as shown in FIG. 2, a conventional screening technique may alternatively be employed to dispose color dyes in the compartments of the waffle grid belt 146 in accordance with a desired pattern. Such a technique would generally employ a separate screen grid for each color, with the grid disposed on the upper surface of the belt 146 and the corresponding color rolled or sprayed through the grid or screen openings.

Figure 6:
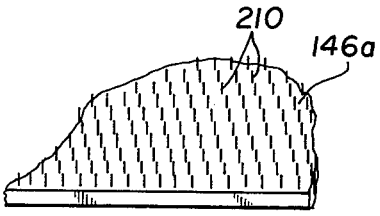
FIG. 6 shows an alternative embodiment of the belt employed in the apparatus of FIG. 1.

Instead of the waffle grid structure of the belt 146 as shown in FIG. 2, the belt 146 may alternatively be provided with a large number of closely spaced spikes, with the surface tension of the dye serving to hold it in place among the spikes. Such a spiked surface is shown in FIG. 6 for a corresponding belt **146*a*. The particular spike spacing employed is dependent upon the viscosity of the dyes employed, and the spikes 210** should preferably comprise a relatively rigid material such as hard rubber or a suitable plastic.

Figure 7:
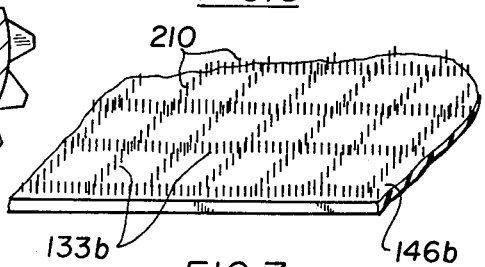
FIG. 7 shows a further embodiment of said belt.

The spikes 210 of the belt **146*a* may be arranged to form the walls 133*a* of color compartments of the belt 146*b*, as best shown in FIG. 7**.

What is claimed is:

1. In a process of applying a coloring agent to a fabric having pile on one face thereof wherein an area of pile on the face of the fabric is introduced into a receptacle comprising a movable belt having a multiplicity of compartments with upstanding side walls therebetween and containing a coloring agent in liquid form, and the receptacle and the fabric are brought into mutual engagement by exerting pressure against the back of the fabric, the improvement comprising the steps of:

driving said belt in a generally horizontal direction at a predetermined speed;

feeding said fabric toward said region of engagement;

rotating a pressure roller having a protuberance-bearing surface adjacent said belt, at a peripheral speed equal to said predetermined speed and in synchronism with the movement of said belt, adjacent said region of engagement, so that the protuberances of said pressure roller urge said fabric toward each of said compartments; and supplying said coloring agent to said compartments upstream of said region of engagement in accordance with a desired color pattern to be printed on said fabric.

2. The process according to claim 1, further comprising means for feeding said fabric toward said region of engagement at an acute angle.

3. The process according to claim 2, wherein a counter roller supports and is rotated by said belt at said region of engagement.

4. The process according to claim 1, wherein said coloring agent is supplied by injection from a plurality of nozzles.

5. The process according to claim 1, wherein said coloring agent is supplied by screening.

6. An apparatus for applying a coloring agent to a fabric having pile on one face thereof wherein an area of pile on the face of the fabric is introduced into a receptacle, comprising a movable belt having a multiplicity of compartments with upstanding side walls therebetween for containing a coloring agent in liquid form, and means for bringing the receptacle and the fabric into mutual engagement by exerting pressure against the back of the fabric, the improvement comprising:

means for driving said belt in a generally horizontal direction at a predetermined speed;

a plurality of rollers for feeding said fabric toward said region of engagement;

a counter roller for supporting said belt at said region of engagement;

a pressure roller disposed adjacent said belt opposite said counter roller, said pressure roller having a protuberance-bearing surface;

means for rotating said pressure roller at a peripheral speed equal to said predetermined speed and in synchronism with the movement of said belt, so that the protuberances of said pressure roller urge said fabric toward each of said compartments; and means for supplying said coloring agent to said compartments upstream of said region of engagement in accordance with a desired color pattern to be printed on said fabric.

7. The apparatus according to claim 6, wherein said plurality of rollers is disposed so as to feed said fabric toward said region of engagement at an angle of gradual engagement.

8. The apparatus according to claim 6, wherein said supplying means comprises a plurality of nozzles for injecting said coloring agent into said compartments.

9. The apparatus according to claim 6, wherein said supplying means comprises screening apparatus.

10. The apparatus according to claim 6, wherein the protuberances of said pressure roller are of generally cylindrical shape.

11. The apparatus according to claim 6, wherein the protuberances of said pressure roller have generally truncated pyramidal shapes.

12. The apparatus according to claim 6, wherein said protuberances comprise gear-like projections.

13. Apparatus according to claim 6, wherein the walls of said compartments each comprise a plurality of spikes.

14. The process according to claim 1, wherein said fabric is a knitted yarn sleeve.

15. The apparatus according to claim 6, wherein said fabric is a knitted yarn sleeve.

* * * * *